US008253313B2

(12) United States Patent
Inoue et al.

(10) Patent No.: US 8,253,313 B2
(45) Date of Patent: Aug. 28, 2012

(54) SPARK PLUG AND MANUFACTURING METHOD THEREOF

(75) Inventors: Masahiro Inoue, Gifu-ken (JP); Hiroyuki Kameda, Aichi-ken (JP)

(73) Assignee: NGK Spark Plug Co., Ltd. (JP)

( * ) Notice: Subject to any disclaimer, the term of this patent is extended or adjusted under 35 U.S.C. 154(b) by 0 days.

(21) Appl. No.: 13/234,212

(22) Filed: Sep. 16, 2011

(65) Prior Publication Data

US 2012/0074828 A1 Mar. 29, 2012

(30) Foreign Application Priority Data

Sep. 28, 2010 (JP) ..... 2010-216434
Aug. 26, 2011 (JP) ..... 2011-184526

(51) Int. Cl.
*H01T 13/20* (2006.01)

(52) U.S. Cl. ..... 313/141; 445/7; 313/143; 313/145

(58) Field of Classification Search ..... 313/118–145; 123/32, 41, 143 R, 146.5 R, 169 P, 260, 280, 123/169 R, 169 EL, 310; 445/7; 219/121.6, 219/121.64, 56, 117.1, 121.63
See application file for complete search history.

(56) References Cited

U.S. PATENT DOCUMENTS 6,603,246 B2 8/2003 Hori ..... 313/141
6,853,116 B2 2/2005 Hori et al. ..... 123/143

FOREIGN PATENT DOCUMENTS

JP 2001-307857 11/2001
JP 2007-087969 4/2007

*Primary Examiner* — Mariceli Santiago
*Assistant Examiner* — Donald Raleigh
(74) *Attorney, Agent, or Firm* — Kusner & Jaffe

(57) ABSTRACT

A spark plug having improved durability having a ground electrode comprised of a ground electrode base member and a noble metal tip. A center axis of the noble metal tip slants in relation to the center axis of the ground electrode base member at angle θ which satisfies a relation 2°≦θ≦25°.

10 Claims, 13 Drawing Sheets

SPARK PLUG AND MANUFACTURING METHOD THEREOF

FIELD OF THE INVENTION

The present invention relates to a spark plug (ignition plug) which ignites an air-fuel mixture through electrical generation of spark.

BACKGROUND OF THE INVENTION

Conventionally, there has been proposed a spark plug in which, in order to improve ignition performance and durability of its ground electrode, a noble metal tip is embedded into the ground electrode by means of resistance welding such that the noble metal tip projects from the distal end of the base member of the ground electrode (see, for example, Japanese Patent Application Laid-Open (kokai) No. 2001-307857 and Japanese Patent Application Laid-Open (kokai) No. 2007-87969. In the case of a ground electrode in which a noble metal tip is embedded into the ground electrode base member, in some cases, oxide scale is formed at a joint portion between the ground electrode base member and the noble metal tip due to heat generated in an internal combustion engine. Excessive formation of such oxide scale may result in separation of the noble metal tip from the ground electrode base member.

Heretofore, sufficient studies have not been conducted on the joint strength between a noble metal tip and a ground electrode base member in a spark plug in which the noble metal tip is joined to the ground electrode base member through resistance welding.

In view of the above-described circumstances, an object of the present invention is to provide a technique which can improve the durability of a spark plug.

SUMMARY OF THE INVENTION

To solve, at least partially, the above problems, the present invention can be embodied in the following modes or application examples.

APPLICATION EXAMPLE 1

In accordance with a first aspect of the present invention, there is provided a spark plug comprising a rod like center electrode having an insulator provided around the center electrode. A cylindrical tubular metallic shell provided around the insulator. A ground electrode is joined at one end to the metallic shell and forms at the other end a gap in cooperation with the center electrode. The ground electrode includes a ground electrode base member which forms a front end surface and a side surface at the other end. A rod like noble metal tip is embedded in the ground electrode base member, through resistance welding, such that the noble metal tip projects from the front end surface and the side surface and has a facing surface facing the center electrode. The spark plug is characterized in that a direction along which the noble metal tip projects from the front end surface of the ground electrode base member coincides with a longitudinal direction of the noble metal tip and slants in relation to a center axis of the ground electrode base member. An inclination angle $\theta$ of a center axis of the noble metal tip in relation to the center axis of the ground electrode base member satisfies a relation $2° \leqq \theta \leqq 25°$. According to the spark plug of the application example 1, fusion of the ground electrode base member and the noble metal tip at the time of resistance welding is accelerated, whereby the joint strength between the ground electrode base member and the noble metal tip can be increased. As a result, the durability of the spark plug can be enhanced.

APPLICATION EXAMPLE 2

In accordance with a second aspect of the present invention, there is provided a spark plug as described in application example 1, wherein a weld produced through partial melting of the ground electrode base member and the noble metal tip through the resistance welding is present on the side surface of the ground electrode base member around the noble metal tip. The weld extends to boundary regions on the side surface of the ground electrode base member. The boundary regions extend from a boundary between the side surface and the front end surface over a distance of $0.10 \times L$, where L represents a tip embedment length L, which is a length of a portion of the side surface of the ground electrode base member where the noble metal tip is embedded in the ground electrode base member. According to the spark plug of the application example 2, the joint strength between the ground electrode base member and the noble metal tip can be increased sufficiently.

APPLICATION EXAMPLE 3

In accordance with a third aspect of the present invention, there is provided a spark plug as described in application examples 1 or 2, wherein a weld produced through partial melting of the ground electrode base member and the noble metal tip through the resistance welding is present on the side surface of the ground electrode base member around the noble metal tip. A relation $\{(H1+H2)/W\} \geqq 0.40$ is satisfied, where H1 and H2 represent respective widths of portions of the weld located on opposite sides of the noble metal tip, as measured at a reference position which is shifted, by a distance of $0.25 \times L$, from a boundary between the side surface and the front end surface of the ground electrode base member, where L represents a tip embedment length L, which is a length of a portion of the side surface of the ground electrode base member where the noble metal tip is embedded in the ground electrode base member. "W" represents a tip width, which is a with of the facing surface as measured along a direction orthogonal to the longitudinal direction of the noble metal tip. According to the spark plug of the application example 3, the joint strength between the ground electrode base member and the noble metal tip can be increased sufficiently.

APPLICATION EXAMPLE 4

In accordance with a fourth aspect of the present invention, there is provided a spark plug as described in any one of application examples 1 to 3, wherein a relation $(A/B) \leqq 0.60$ is satisfied. "A" represents a projection length, which is a length of a portion of the noble metal tip, which portion projects from the front end surface of the ground electrode base member. "B" represents a tip overall length, which is a length of the noble metal tip as measured along the longitudinal direction. According to the spark plug of the application example 4, the joint strength between the ground electrode base member and the noble metal tip can be secured sufficiently.

APPLICATION EXAMPLE 5

In accordance with a fifth aspect of the present invention, there is provided a spark plug described in any one of application examples 1 to 4, wherein a relation $(C/D) \leqq 0.60$ is satisfied. "C" represents a projection thickness, which is a length of a portion of the noble metal tip, which portion projects from the side surface of the ground electrode base member. "D" represents a tip thickness, which a length of the noble metal tip as measured along a direction along which the noble metal tip is embedded into the side surface. According to the spark plug of the application example 5, the joint strength between the ground electrode base member and the noble metal tip can be secured sufficiently.

APPLICATION EXAMPLE 6

In accordance with a sixth aspect of the present invention, there is provided a method for manufacturing a spark plug which comprises a rodlike center electrode; an insulator provided around the center electrode; a cylindrical tubular metallic shell provided around the insulator; and a ground electrode which is joined at one end to the metallic shell and which forms at the other end a gap in cooperation with the center electrode. The ground electrode includes a ground electrode base member which forms a front end surface and a side surface at the other end. A rod like noble metal tip is embedded in the ground electrode base member, through resistance welding, such that the noble metal tip projects from the front end surface and the side surface and which has a facing surface facing the center electrode. The method being characterized by comprising a first attachment step of attaching the ground electrode base member to a first welding electrode; a second attachment step of attaching the noble metal tip to a slant surface of a second welding electrode which surface slants at an angle θ in relation to the side surface of the ground electrode base member attached to the first welding electrode, the angle satisfying a relation $2° \leqq \theta \leqq 25°$; and a welding step of moving the second welding electrode holding the noble metal tip attached thereto, in relation to the first welding electrode holding the ground electrode base member attached thereto, in a direction orthogonal to the side surface of the ground electrode base member attached to the first welding electrode, to thereby press the ground electrode base member and the noble metal tip together between the first welding electrode and the second welding electrode, and causing, in this state, a current to flow through the ground electrode base member and the noble metal tip. According to the method for manufacturing a spark plug of the application example 6, fusion of the ground electrode base member and the noble metal tip at the time of resistance welding is accelerated, whereby the joint strength between the ground electrode base member and the noble metal tip can be increased. As a result, the durability of the spark plug can be enhanced.

APPLICATION EXAMPLE 7

In accordance with a seventh aspect of the present invention, there is provided a method for manufacturing a spark plug which comprises a rodlike center electrode; an insulator provided around the center electrode; a cylindrical tubular metallic shell provided around the insulator; and a ground electrode which is joined at one end to the metallic shell and which forms at the other end a gap in cooperation with the center electrode. The ground electrode includes a ground electrode base member which forms a front end surface and a side surface at the other end. A rod like noble metal tip which is embedded in the ground electrode base member, through resistance welding, such that the noble metal tip projects from the front end surface and the side surface and which has a facing surface facing the center electrode. The method is characterized by comprising a first attachment step of attaching the ground electrode base member to a first welding electrode; a second attachment step of attaching the noble metal tip to a slant surface of a second welding electrode which surface slants at an angle θ in relation to the side surface of the ground electrode base member attached to the first welding electrode, the angle satisfying a relation $2° \leqq \theta \leqq 25°$; and a welding step of moving the second welding electrode holding the noble metal tip attached thereto, in relation to the first welding electrode holding the ground electrode base member attached thereto, in a direction orthogonal to the slant surface of the second welding electrode, to thereby press the ground electrode base member and the noble metal tip together between the first welding electrode and the second welding electrode, and causing, in this state, a current to flow through the ground electrode base member and the noble metal tip. According to the method for manufacturing a spark plug of the application example 7, fusion of the ground electrode base member and the noble metal tip at the time of resistance welding is accelerated, whereby the joint strength between the ground electrode base member and the noble metal tip can be increased. As a result, the durability of the spark plug can be enhanced.

The present invention is not limited to a mode in which the present invention is implemented in the form of a spark plug. For example, the present invention can be applied to various other modes in which the present invention is implemented in the form of a ground electrode of a spark plug, an internal combustion engine including a spark plug, or the like. Also, the present invention is not limited to the above-described modes, and can be practiced in various forms without departing from the scope of the invention.

DETAILED DESCRIPTION OF PREFERRED EMBODIMENTS

A spark plug to which the present invention is applied will now be described for further understanding of the above-described configuration and action of the present invention.

A. Embodiment

A-1. Structure of Spark Plug

Figure 1:
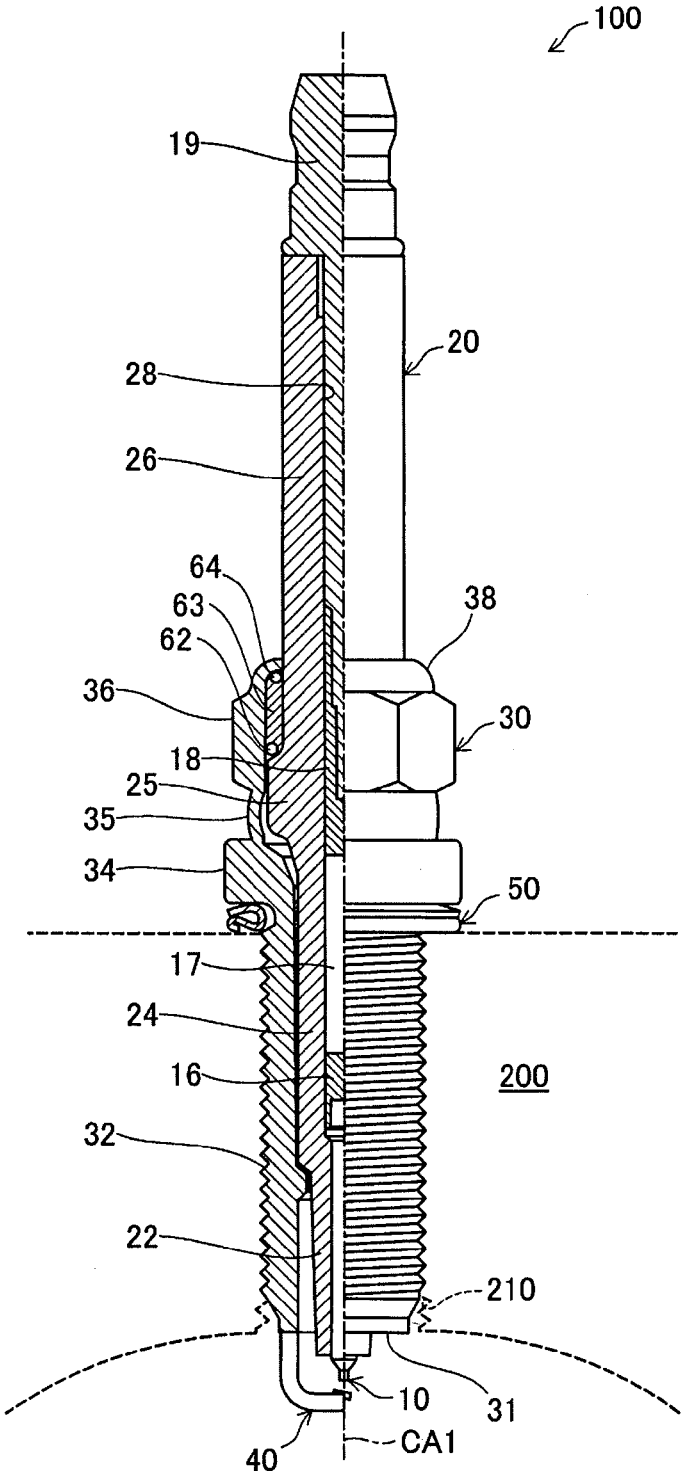
FIG. 1 is a partial cross-sectional view showing a spark plug.

FIG. 1 is a partial cross-sectional view showing a spark plug 100. In FIG. 1, the external shape of the spark plug 100 is illustrated on one side of a center axis CA1 of the spark plug 100, and the cross-sectional shape of the spark plug 100 is illustrated on the other side thereof.

The spark plug 100 includes a center electrode 10, an insulator 20, a metallic shell 30, and a ground electrode 40. In the present embodiment, the center axis CA1 of the spark plug 100 also serves as respective center axes of the center electrode 10, the insulator 20, and the metallic shell 30.

In the spark plug 100, the rodlike center electrode 10 extends along the center axis CA1, and is surrounded by the insulator 20. The insulator 20 electrically insulates the circumference of the center electrode 10. One end of the center electrode 10 projects from one end of the insulator 20.

A cylindrical tubular metallic shell 30 is provided around the insulator 20 such that it is electrically insulated from the center electrode 10. In the present embodiment, the metallic shell 30 is fixed to the insulator 20 through crimping. One end of the ground electrode 40 is joined to the metallic shell 30, and the other end of the ground electrode 40 and the center electrode 10 form therebetween a spark gap, which is a clearance for generation of spark.

The metallic shell 30 is screwed into a mount screw hole 210 formed in an engine head 200 of an internal combustion engine (not shown), whereby the spark plug 100 is attached to the engine. When a high voltage of 20,000 V to 30,000 V is applied to the center electrode 10, spark is generated at the spark gap formed between the center electrode 10 and the ground electrode 40.

The center electrode 10 of the spark plug 100 is a rodlike electrode composed of an electrode base member formed into a bottomed tubular shape, and a core which is embedded in the electrode base member and is higher in heat conductivity than the electrode base member. In the present embodiment, the center electrode 10 is fixed to the insulator 20 in a state in which the distal end of the electrode base member projects from one end of the insulator 20, and is electrically connected to a terminal metal piece 19 via a seal member 16, a ceramic resistor 17, and a seal member 18.

In the present embodiment, the electrode base member of the center electrode 10 is formed of a nickel alloy whose main component is nickel, such as Inconel (registered trademark), and the core of the center electrode 10 is formed of copper or an alloy whose main component is copper. In the present embodiment, a noble metal tip whose main component is iridium is welded to the distal end of the electrode base member of the center electrode 10.

The insulator 20 of the spark plug 100 is a member formed by firing an insulative ceramic material such as alumina. The insulator 20 is a tubular body having an axial hole 28 for receiving the center electrode 10. Insulator 20 includes a leg portion 22, a first insulator trunk portion 24, a insulator flange portion 25, and a second insulator trunk portion 26 formed along the center axis CA1 in this sequence from the side of spark plug 100 from which the center electrode 10 projects.

The leg portion 22 of the insulator 20 is a tubular portion whose outer diameter deceases toward the side toward which the center electrode 10 projects. The first insulator trunk portion 24 of the insulator 20 is a tubular portion having an outer diameter greater than that of the leg portion 22. The insulator flange portion 25 of the insulator 20 is a tubular portion having an outer diameter greater than that of the first insulator trunk portion 24. The second insulator trunk portion 26 of the insulator 20 is a tubular portion having an outer diameter smaller than that of the insulator flange portion 25, and establishes a sufficient insulation distance between the metallic shell 30 and the terminal meal piece 19.

In the present embodiment, the metallic shell 30 of the spark plug 100 is a member formed of low carbon steel and plated with nickel. However, the metallic shell 30 may be a member formed of low carbon steel and plated with zinc, or an unplated member formed of a nickel alloy. In the present embodiment, the metallic shell 30 is fixed to the insulator 20 through cold crimping. However, the metallic shell 30 may be fixed to the insulator 20 through hot crimping. The metallic shell 30 includes an end surface 31, a mount screw portion 32, a trunk portion 34, a groove portion 35, a tool engagement portion 36, and a crimp portion 38 formed along the center axis CA1 in this sequence from the side of spark plug 100 from which the center electrode 10 projects.

The end surface 31 of the metallic shell 30 is an annular surface formed at the distal end of the mount screw portion 32. The ground electrode 40 is joined to the end surface 31. The center electrode 10, which is surrounded by the leg portion 22 of the insulator 20, projects through a center opening defined by and surrounded by the end surface 31. The mount screw portion of the metallic shell 30 is a cylindrical tubular portion having, on its outer circumference, a screw thread which is screwed into the mount screw hole 210 of the engine head 200.

The trunk portion 34 of the metallic shell 30 is a flange-shaped portion which is provided adjacent to the groove portion 35 and projects radially outward in relation to the groove portion 35. The trunk portion 34 compresses a gasket 50 toward the engine head 200. The groove portion 35 of the metallic shell 30 is a portion which is provided between the trunk portion 34 and the tool engagement portion 36 and projects radially outward when the metallic shell 30 is fixed to the insulator 20 through crimping. The tool engagement portion 36 of the metallic shell 30 is a flange-shaped portion which is provided adjacent to the groove portion 35 and bulges radially outward in relation to the groove portion 35. The tool engagement portion 36 is formed into a shape corresponding to the shape of a tool (not shown) used to mount the spark plug 100 to the engine head 200.

The crimp portion 38 of the metallic shell 30 is a portion which is provided adjacent to the tool engagement portion 36. The crimp portion 38 is deformed for close contact with the second insulator trunk portion 26 of the insulator 20 when the metallic shell 30 is fixed to the insulator 20 through crimping. Powder of talc is charged into a region between the crimp portion 38 of the metallic shell 30 and the insulator flange portion 25 of the insulator 20, whereby a talc charged portion 63 is formed, and is sealed by packings 62 and 64.

Figure 2:
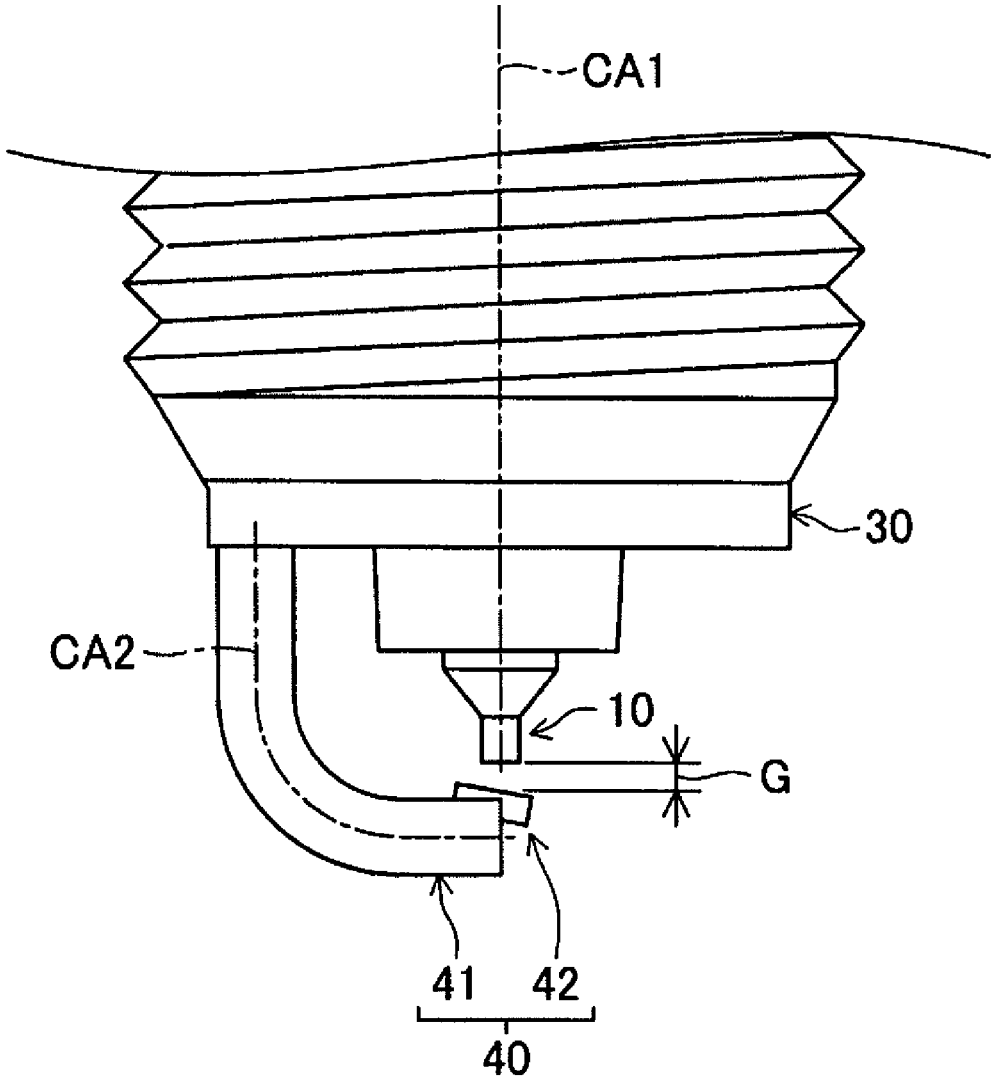
FIG. 2 is an explanatory view showing, on an enlarged scale, the ground electrode of the spark plug.

FIG. 2 is an explanatory view showing, on an enlarged scale, the ground electrode 40 of the spark plug 100. The ground electrode 40 of the spark plug 100 includes a ground electrode base member 41 and a noble metal tip 42. One end of the ground electrode base member 41 is joined to the metallic shell 30, and the noble metal tip 42 is provided at the other end of the ground electrode base member 41, whereby a spark gap G is formed between the noble metal tip 42 and the center electrode 10.

The ground electrode base member 41 of the ground electrode 40 is an electrode which extends from the metallic shell 30 toward the center electrode 10. The center axis CA2 of the ground electrode base member 41 extends from the metallic shell 30 along the center axis CA1, and then bends toward the center electrode 10; i.e., extends along a direction intersecting the center axis CA1. In the present embodiment, the outer layer of the ground electrode base member 41 is formed of a nickel alloy whose main component is nickel, such as Inconel (registered trademark), and the inner layer of the ground electrode base member 41 is formed of copper or a copper alloy whose heat conductivity is higher than that of the outer layer.

The noble metal tip 42 of the ground electrode 40 is a rodlike member formed of a material containing a noble metal. The noble metal tip 42 is embedded in the ground electrode base member 41 by means of resistance welding such that the noble metal tip 42 projects toward the center electrode 10. In the present embodiment, the noble metal tip 42 assumes the form of a rectangular parallelepiped rod. However, the noble metal tip 42 may assume the form of a cylindrical columnar rod. In the present embodiment, the noble metal tip 42 is formed of a noble metal alloy which contains platinum (main component) and rhodium (20% by mass).

Figure 3:
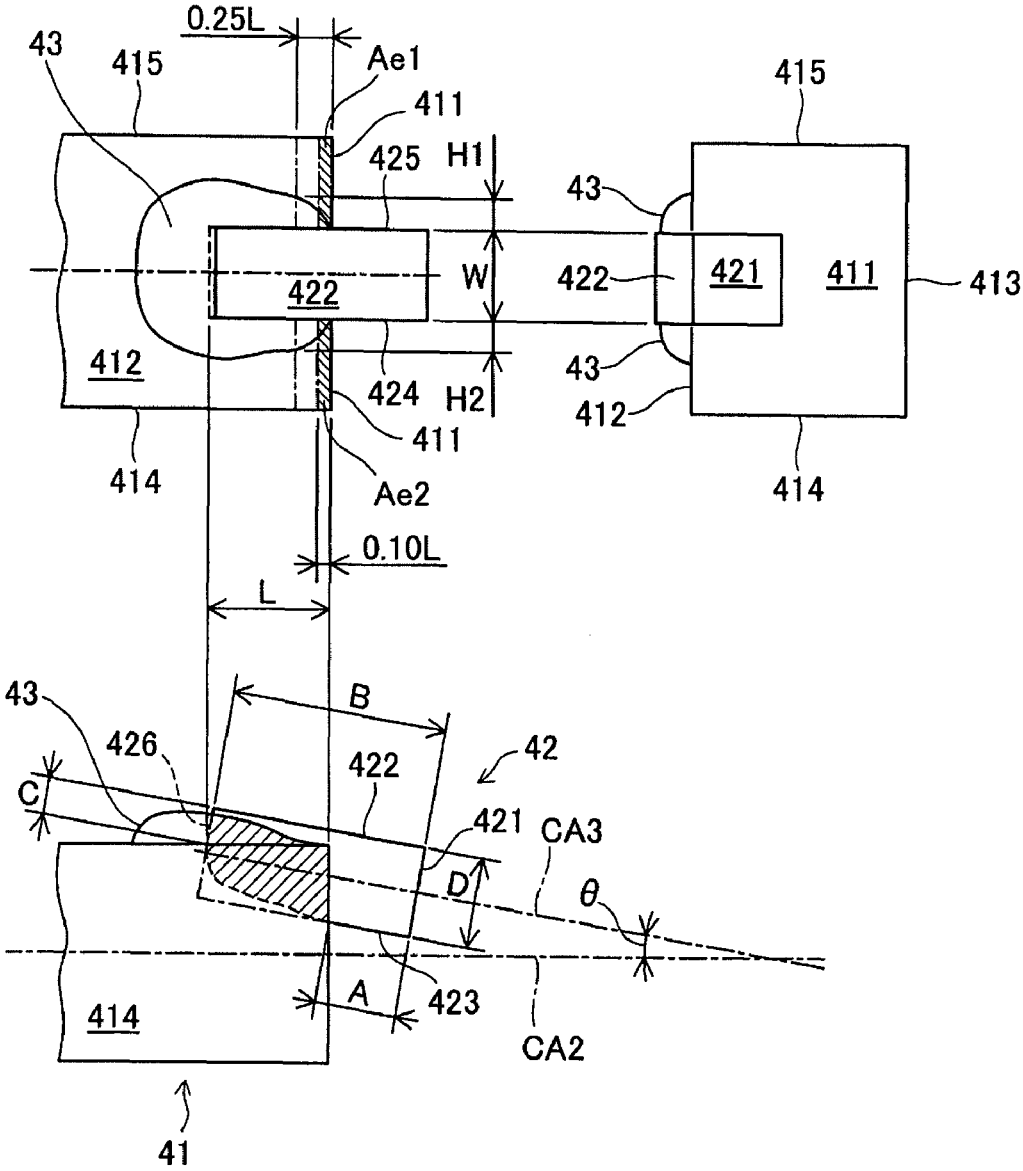
FIG. 3 is an explanatory view showing, in detail, the structure of the ground electrode.

FIG. 3 is an explanatory view showing the structure of the ground electrode 40 in detail. In the upper section of FIG. 3, a top view of the ground electrode 40 as viewed from the center electrode 10 side, and a side view of the ground electrode 40 as viewed from the distal end side are illustrated. In the lower section of FIG. 3, a front view of the ground electrode 40, as viewed from a front side from which the bent shape of the ground electrode base member 41 can be seen, illustrated.

In the present embodiment, the ground electrode base member 41 of the ground electrode 40 has a rectangular cross-sectional shape, as taken perpendicular to the center axis CA2, and includes a first base member surface 411, a second base member surface 412, a third base member surface 413, a fourth base member surface 414, and a fifth base member surface 415. The first base member surface 411 of the ground electrode base member 41 is a distal end surface of the ground electrode base member 41. The second base member surface 412 of the ground electrode base member 41 is a side surface among the side surfaces adjacent to the first base member surface 411, which side surface is located on the inner side of the bent shape. In the present embodiment, the first base member surface 411 is a flat surface extending along the center axis CA1 of the center electrode 10, and the second base member surface 412 is a flat surface orthogonal to the center axis CA1 of the center electrode 10.

The third base member surface 413 of the ground electrode base member 41 is a side surface among the side surfaces adjacent to the first base member surface 411, which side surface is located on the outer side of the bent shape. The fourth base member surface 414 and the fifth base member surface 415 of the ground electrode base member 41 are side surfaces among the side surfaces adjacent to the first base member surface 411, which side surfaces extend between the second base member surface 412 and the third base member surface 413.

The noble metal tip 42 of the ground electrode 40 is joined to the ground electrode base member 41 through resistance welding such that the noble metal tip 42 is embedded in the ground electrode base member 41 and projects from the first base member surface 411 and the second base member surface 412 of the ground electrode base member 41. The noble metal tip 42 projects from the first base member surface 411 of the ground electrode base member 41 in a direction which coincides with the longitudinal direction of the noble metal tip 42 (the center axis CA3 of the noble metal tip 42) and which inclines in relation to the center axis CA2 of the ground electrode base member 41.

A tip inclination angle θ, at which the center axis CA3 of the noble metal tip 42 inclines in relation to the center axis CA2 of the ground electrode base member 41, preferably satisfies a relation "$2° \leqq \theta \leqq 25°$," more preferably a relation "$5° \leqq \theta \leqq 20°$," most preferably, a relation "$10° \leqq \theta 20°$." The tip inclination angle θ is an angle which the center axis CA3 of the noble metal tip 42 forms in relation to the center axis CA2 of the ground electrode base member 41, as projected on a plane which includes the center axis CA1 of the center electrode 10 and the center axis CA2 of the ground electrode base member 41. An evaluation value regarding the tip inclination angle θ will be described later.

In the present embodiment, the noble metal tip 42 has a rectangular cross-sectional shape along the center axis CA3, and has a first tip surface 421, a second tip surface 422, a third tip surface 423, a fourth tip surface 424, a fifth tip surface 425, and a sixth tip surface 426. The first tip surface 421 of the noble metal tip 42 is one end surface of the noble metal tip 42 projecting from the first base member surface 411 of the ground electrode base member 41. The second tip surface 422 of the noble metal tip 42 is one side surface among the side surfaces adjacent to the first tip surface 421, which side surface is not buried in the ground electrode base member 41 and which is a facing surface facing the center electrode 10.

The third tip surface 423 of the noble metal tip 42 is one side surface among the side surfaces adjacent to the first tip surface 421, which side surface is located opposite the second tip surface 422. The fourth tip surface 424 and the fifth tip surface 425 of the noble metal tip 42 are side surfaces extending between the second tip surface 422 and the third tip surface 423. The sixth tip surface 426 of the noble metal tip 42 is the other end surface of the noble metal tip 42 located opposite the first tip surface 421.

As shown in FIG. 3, a weld 43 is formed on the second base member surface 412 of the ground electrode base member 41 around the noble metal tip 42. The weld 43 is formed as follows. As a result of resistance welding, a portion of the noble metal tip 42 and a portion of the ground electrode base member 41 are melted, and the resultant molten alloy solidifies and forms the weld 43 projecting from the second base member surface 412 of the ground electrode base member 41.

In the present embodiment, the weld 43 extends to boundary regions Ae1 and Ae2 of the second base member surface 412 of the ground electrode base member 41. Each of the boundary regions Ae1 and Ae2 extends from the boundary between the second base member surface 412 and the first base member surface 411 over a distance of "0.10×L," where L represents a tip embedment length L, which is the length of a portion of the second base member surface 412 of the ground electrode base member 41, in which portion the noble metal tip 42 is embedded. In FIG. 3, the boundary regions Ae1 and Ae2 of the second base member surface 412, which extend on opposite sides of the noble metal tip 42, are shown.

Weld widths H1 and H2, which are respective widths of portions of the weld 43 present on the opposite sides of the noble metal tip 42, and tip width W, which is the width of the noble metal tip 42, preferably satisfy a relation "{(H1+H2)/

W}≧0.40," more preferably a relation "{(H1+H2)/W}≧0.60," and most preferably a relation "{(H1+H2)/W}≧1.00." The weld widths H1 and H2 are respective widths of portions of the weld 43 present on the opposite sides of the noble metal tip 42, as measured at a reference position on the second base member surface 412 of the ground electrode base member 41, which position is shifted from the boundary between the second base member surface 412 and the first base member surface 411 by "0.25×L." The tip width W is a width of the second tip surface 422 as measured along a direction orthogonal to the center axis CA3 of the noble metal tip 42. An evaluation value regarding the width ratio {(H1+H2)/W} between the noble metal tip 42 and the weld 43 will be described later.

Projection length A, which is the length of a portion of the noble metal tip 42, which portion projects from the first base member surface 411 of the ground electrode base member 41, and tip overall length B, which is the length of the noble metal tip 42 as measured along the center axis CA3, preferably satisfy a relation "(A/B)≦0.60," more preferably a relation "(A/B)≦0.50," most preferably, a relation "(A/B)≦0.40." In the present embodiment, the projection length A of the noble metal tip 42 is the length of a portion of the third tip surface 423 of the noble metal tip 42, which portion projects from the first base member surface 411 of the ground electrode base member 41. An evaluation value regarding the tip length embedment ratio (A/B) of the noble metal tip 42 will be described later.

Projection thickness C, which is the length of a portion of the noble metal tip 42, which portion projects from the second base member surface 412 of the ground electrode base member 41, and tip thickness D, which is the length of the noble metal tip 42 as measured along the direction along which the noble metal tip 42 is embedded into the second base member surface 412 of the ground electrode base member 41, preferably satisfy a relation "(C/D)≦0.60," more preferably a relation "(C/D)≦0.30," most preferably "(C/D)≦0.15." In the present embodiment, the projection thickness C of the noble metal tip 42 is the length of a portion of the sixth tip surface 426 of the noble metal tip 42, which portion projects from the second base member surface 412 of the ground electrode base member 41. An evaluation value regarding the tip thickness embedment ratio (C/D) of the noble metal tip 42 will be described later.

A-2. Evaluation Value Regarding the Tip Inclination Angle θ

Figure 4:
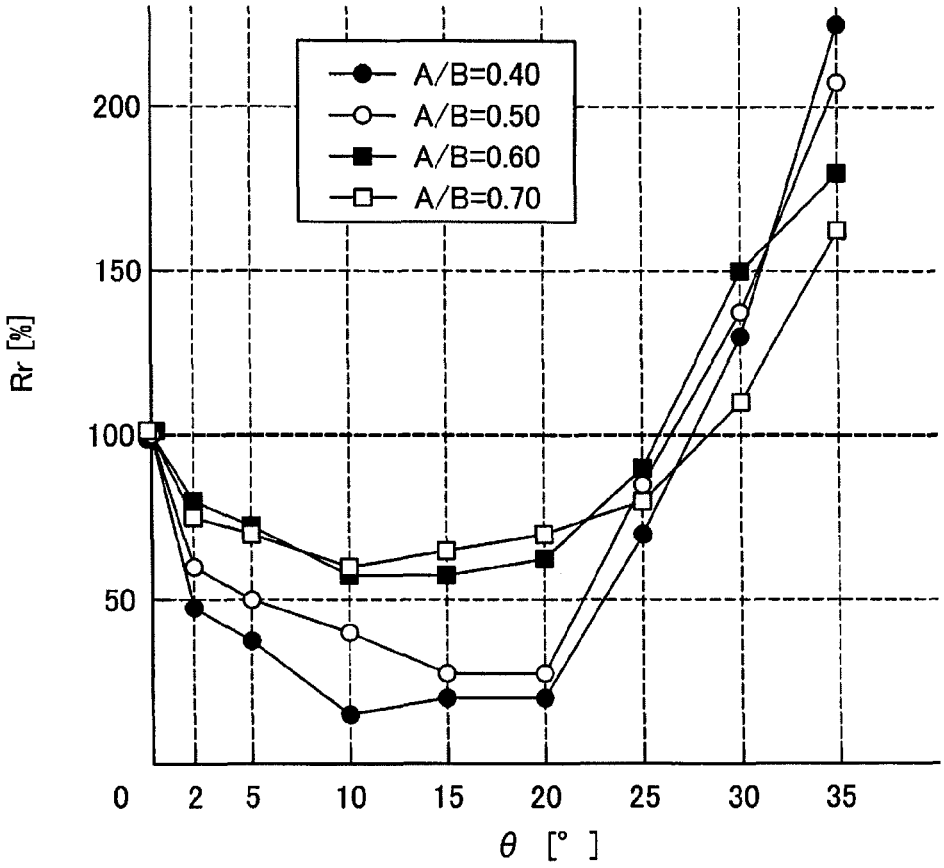
FIG. 4 is an explanatory graph showing the results of an evaluation test performed for investigating the relation between tip inclination angle and oxide scale.

FIG. 4 is an explanatory graph showing the results of an evaluation test performed for investigating the relation between the tip inclination angle θ and oxide scale. In the evaluation test whose results are shown in FIG. 4, a plurality of samples differing in the tip inclination angle θ were prepared and heated. After that, the ground electrode 40 of each sample was cut, and formation of oxide scale at the joint portion between the ground electrode base member 41 and the noble metal tip 42 was checked. Such oxide scale, which is formed at the joint portion between the ground electrode base member 41 and the noble metal tip 42 due to excessive heating of the ground electrode 40, causes separation of the noble metal tip 42 from the ground electrode base member 41.

Specifically, the samples used in the evaluation test whose results are shown in FIG. 4 were manufactured such that they satisfied the conditions of the tip overall length B being 1.50 mm, the tip width W being 0.70 mm, and the tip thickness embedment ratio (C/D) being 0.60; and they differed from one another in terms of the tip length embedment ratio (A/B) and the tip inclination angle θ. The tip length embedment ratio (A/B) was changed among "0.40," "0.50," "0.60," and "0.70." The tip inclination angle θ was changed among "0°," "2°," "5°," "10°," "15°," "20°," "25°," "30°," and "35°."

Specifically, in the evaluation test whose results are shown in FIG. 4, each sample was subjected to 1000 heating cycles each composed of heating of the sample at 1050° C. for 2 minutes by use of a burner in an atmosphere of room temperature and normal humidity, and subsequent cooling of the sample for one minute at room temperature. After that, the sample was cut, and there was calculated an oxide scale change percentage Rc, which is the ratio of a portion of the joint portion between the ground electrode base member 41 and the noble metal tip 42, the portion having changed to oxide scale. The oxide scale change percentage Rc is the ratio of (the length of) a region occupied by the oxide scale to a tip welding allowance (B-A), which is obtained by subtracting the projection length A from the tip overall length B of the noble metal tip 42. In the evaluation test whose results are shown in FIG. 4, in order to confirm an oxide scale reduction effect attained by changing the tip inclination angle θ, there was calculated a relative ratio Rr between the oxide scale change percentage Rc of a sample whose tip inclination angle θ was 0° and the oxide scale change percentage Rc of a sample whose tip inclination angle θ was changed from 0°.

FIG. 4 shows the relation between the tip inclination angle θ and oxide scale. The horizontal axis represents the tip inclination angle θ, and the vertical axis represents the relative ratio Rr of the change percentage Rc in relation to that of the sample whose tip inclination angle θ is 0°. FIG. 4 shows that samples whose tip inclination angles θ fall within a range in which the relative ratio Rr of the oxide scale change percentage becomes lower than 100% can suppress generation of oxide scale, as compared with the samples whose tip inclination angle θ is 0°.

As shown in FIG. 4, it was found that irrespective of the tip length embedment ratio (A/B), in the case of samples whose tip inclination angles θ satisfy the relation "2°≦θ≦25°," the relative ratio Rr of the oxide scale change percentage becomes lower than 100%, whereby generation of oxide scale can be suppressed more as compared with the samples whose tip inclination angle θ is 0°. It was also found that, irrespective of the tip length embedment ratio (A/B), the relative ratio Rr of the oxide scale change percentage decreases as the tip inclination angle θ increases from "0°," to "2°," to "5°," and to "10°." The relative ratio Rr of the oxide scale change percentage assumes a substantially stable value when the tip inclination angle θ satisfies the relation "10°≦θ≦20°," and tends to increase when the tip inclination angle θ exceeds "20°." When the tip inclination angle θ exceeds "25°" and becomes equal to or greater than "30°," the relative ratio Rr of the oxide scale change percentage becomes equal to or greater than 100%, and the oxide scale change percentage Rc becomes worse as compared with the samples whose tip inclination angles θ are 0°.

The results of the above-described evaluation test shown in FIG. 4 demonstrate that the tip inclination angle θ preferably satisfies a relation "2°≦θ≦25°," more preferably a relation "5°≦θ≦20°," most preferably a relation "10°≦θ≦20°."

A-3. Evaluation Value Regarding the Width Ratio {(H1+H2)/W} Between the Noble Metal Tip 42 and the Weld 43

Figure 5:
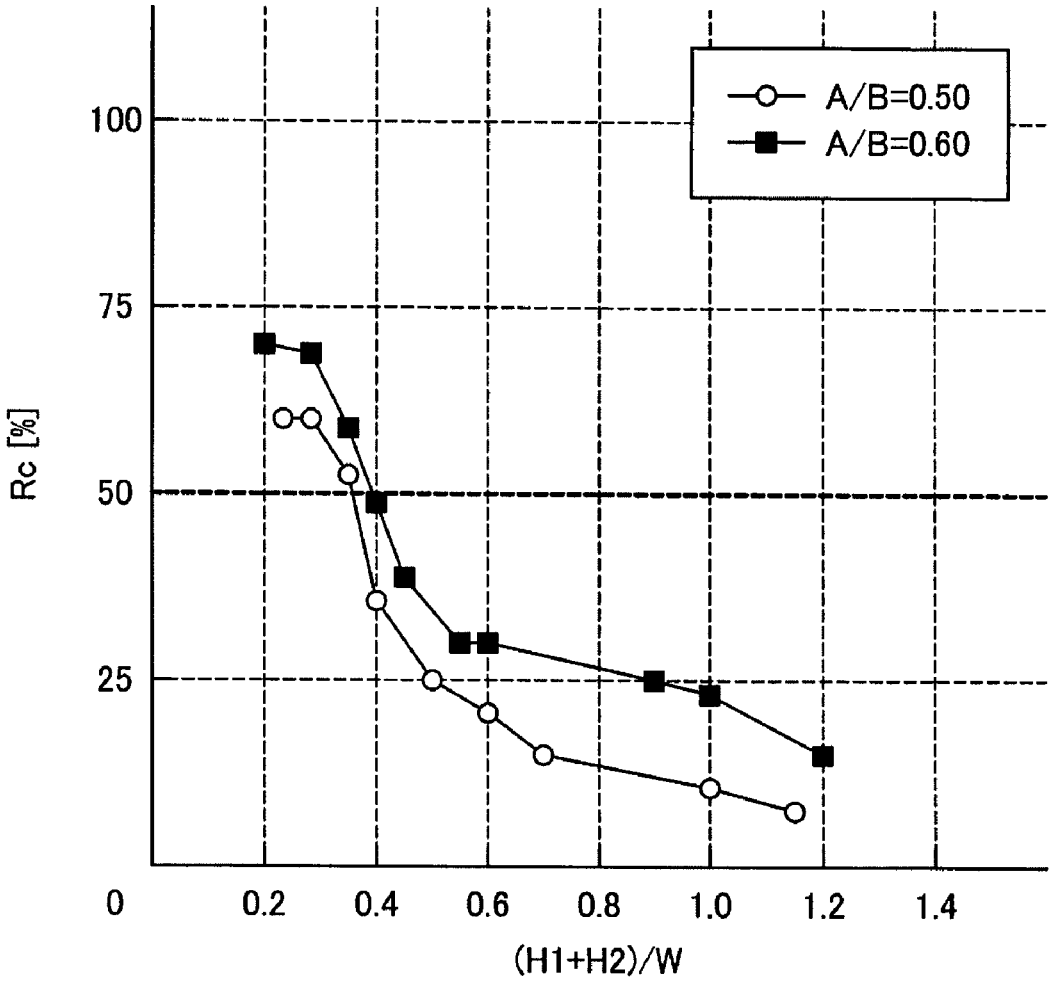
FIG. 5 is an explanatory graph showing the results of an evaluation test performed for investigating the relation between the width ratio between a noble metal tip and a weld, and oxide scale.

FIG. 5 is an explanatory graph showing the results of an evaluation test performed for investigating the relation between the width ratio {(H1+H2)/W} between the noble metal tip 42 and the weld 43 and oxide scale. In the evaluation test whose results are shown in FIG. 5, a plurality of samples differing in the width ratio {(H1+H2)/W} were prepared and heated. After that, the ground electrode 40 of each sample was cut, and formation of oxide scale at the joint portion between the ground electrode base member 41 and the noble metal tip 42 was checked.

Specifically, the samples used in the evaluation test whose results are shown in FIG. 5, were manufactured such that they satisfied the conditions of the tip overall length B being 1.50 mm, the tip width W being 0.70 mm, and the tip thickness embedment ratio (C/D) being 0.60; and they differed from one another in terms of the tip length embedment ratio (A/B) and the weld widths H1 and H2. The tip length embedment ratio (A/B) was changed between "0.50" and "0.60."

Specifically, in the evaluation test whose results are shown in FIG. 5, like in the evaluation test of FIG. 4, each sample was subjected to 1000 heating cycles each composed of heating of the sample at 1050° C. for 2 minutes and subsequent cooling of the sample for one minute at room temperature. After that, the sample was cut, and there was calculated the oxide scale change percentage Rc, which is the ratio of a portion of the joint portion between the ground electrode base member 41 and the noble metal tip 42, the portion having changed to oxide scale.

FIG. 5 shows the relation between the width ratio {(H1+H2)/W} and oxide scale. The horizontal axis represents the width ratio {(H1+H2)/W}, and the vertical axis represents the oxide scale change percentage Rc. An oxide scale change percentage Rc of 50% is a limit (separation limit) at or above which the noble metal tip 42 is highly likely to separate from the ground electrode base member 41. Any sample (spark plug) whose oxide scale change percentage Rc is less than 50% (the separation limit) has sufficient durability for practical use.

As shown in FIG. 5, it was found that irrespective of the tip length embedment ratio (A/B), in the case of samples whose width ratios {(H1+H2)/W} are equal to or greater than "0.4," the oxide scale change percentage Rc becomes less than 50% (the separation limit), whereby generation of oxide scale can be suppressed. It was also found that, irrespective of the tip length embedment ratio (A/B), the oxide scale change percentage Rc decreases as the width ratio {(H1+H2)/W} increases. When the width ratio {(H1+H2)/W} becomes "0.60" or greater, the rate of decrease of the oxide scale change percentage Rc decreases. It was found that, when the width ratio {(H1+H2)/W} becomes "1.00" or greater, the oxide scale change percentage Rc becomes 25% or less, and generation of oxide scale can be suppressed sufficiently.

The results of the above-described evaluation test shown in FIG. 5 demonstrate that the width ratio {(H1+H2)/W} preferably satisfies a relation "{(H1+H2)/W}≧0.40," more preferably a relation "{(H1+H2)/W}≧0.60," most preferably a relation "{(H1+H2)/W}≧1.00."

A-4. Evaluation Value Regarding the Tip Length Embedment Ratio (A/B)

Figure 6:
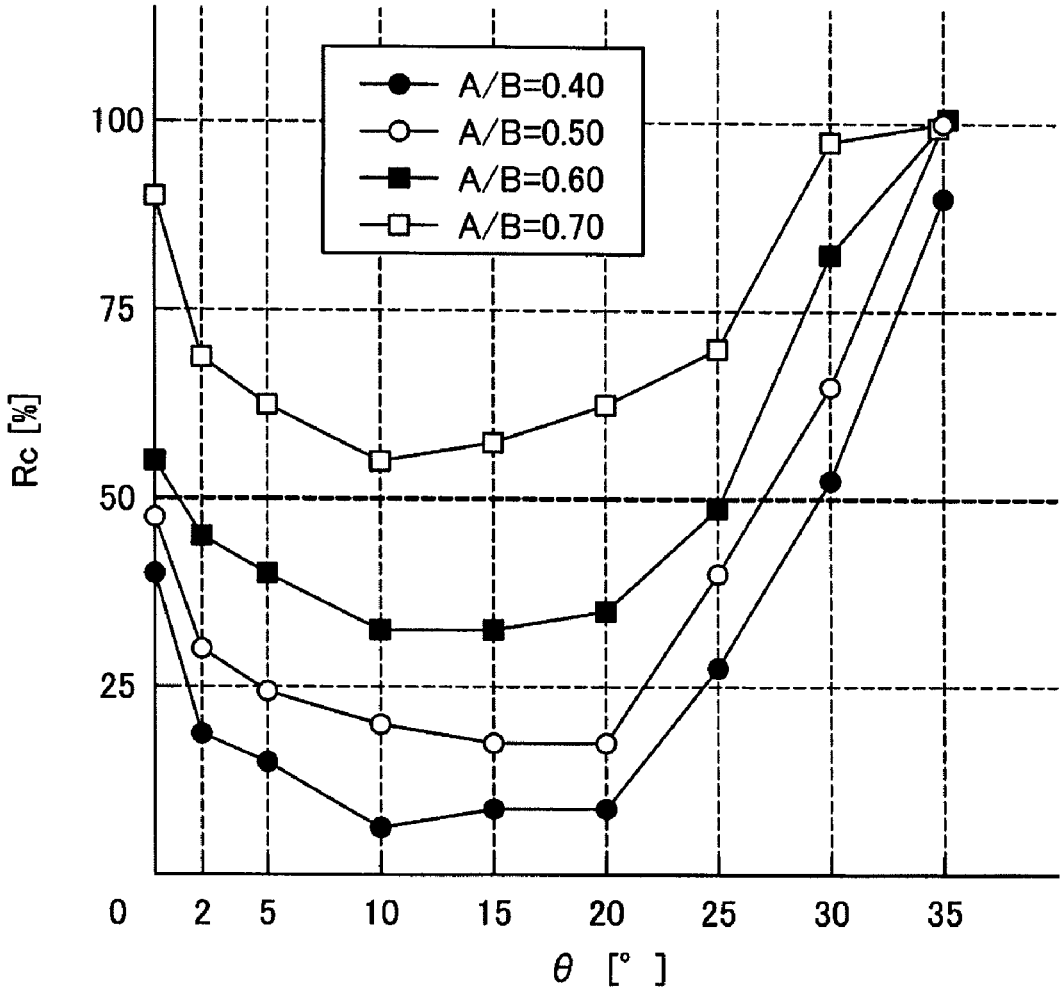
FIG. 6 is an explanatory graph showing the results of an evaluation test performed for investigating the relation between tip length embedment ratio and oxide scale.

FIG. 6 is an explanatory graph showing the results of an evaluation test performed for investigating the relation between the tip length embedment ratio (A/B) and oxide scale. The results of the evaluation test shown in FIG. 6 are identical to those obtained in the evaluation test shown in FIG. 4. In FIG. 6, the horizontal axis represents the tip inclination angle θ, and the vertical axis represents the oxide scale change percentage Rc, whereby the relation between the tip length embedment ratio (A/B) and oxide scale is shown.

As shown in FIG. 6, it was found that in the case of samples whose tip length embedment ratios (A/B) are "0.70," the oxide scale change percentage Rc exceeds 50% (the separation limit) irrespective of the tip inclination angle θ. It was found that, in the case of samples whose tip length embedment ratio (A/B) is "0.40," "0.50," or "0.60," when the tip inclination angle θ satisfies the relation "2°≦θ≦25°," the oxide scale change percentage Rc becomes less than 50%, and found that the oxide scale change percentage Rc decreases as the tip length embedment ratio (A/B) decreases.

The results of the above-described evaluation test shown in FIG. 6 demonstrate that the tip length embedment ratio (A/B) preferably satisfies a relation "(A/B)≦0.60," more preferably a relation "(A/B)≦0.50," most preferably a relation "(A/B)≦0.40."

A-5. Evaluation Value Regarding the Tip Thickness Embedment Ratio (C/D)

Figure 7:
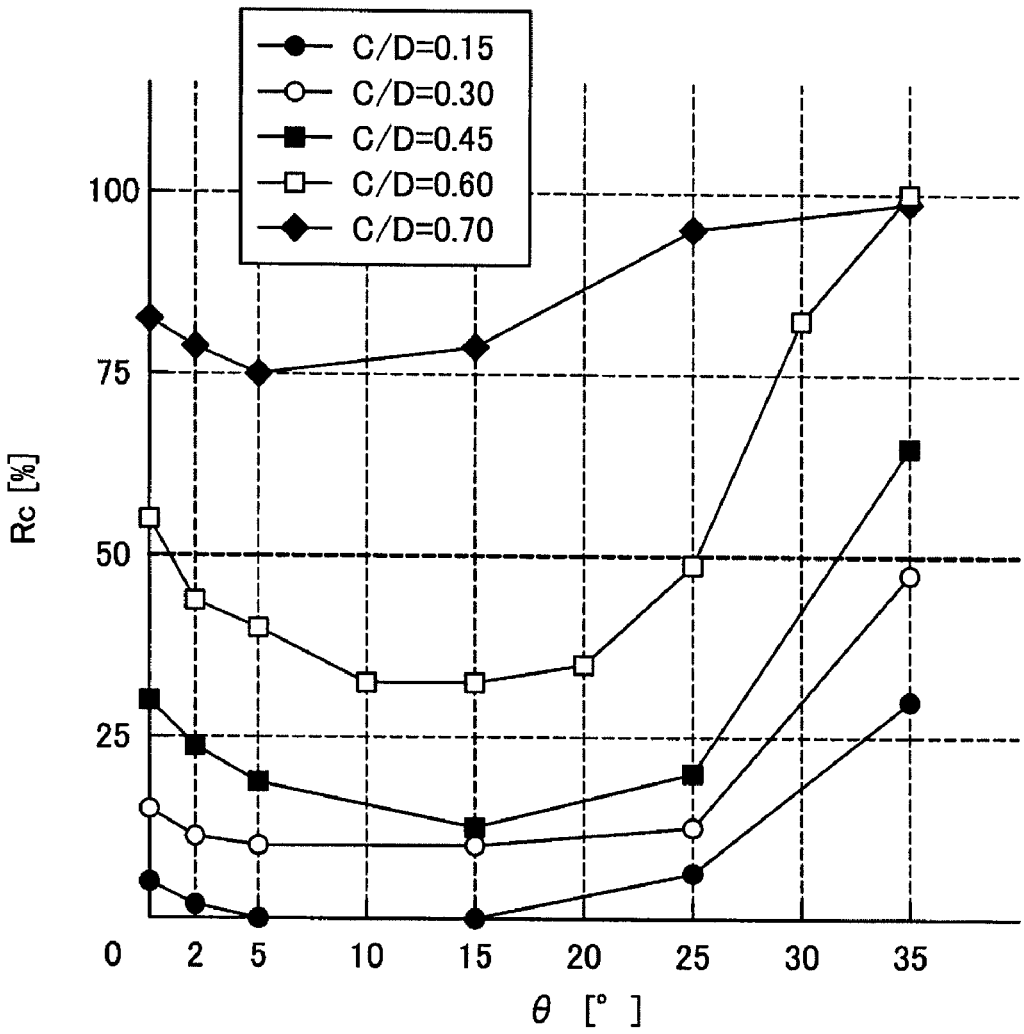
FIG. 7 is an explanatory graph showing the results of an evaluation test performed for investigating the relation between tip thickness embedment ratio and oxide scale.

FIG. 7 is an explanatory graph showing the results of an evaluation test performed for investigating the relation between the tip thickness embedment ratio (C/D) and oxide scale. In the evaluation test whose results are shown in FIG. 7, a plurality of samples differing in the tip thickness embedment ratio (C/D) were prepared and heated. After that, the ground electrode 40 of each sample was cut, and formation of oxide scale at the joint portion between the ground electrode base member 41 and the noble metal tip 42 was checked.

Specifically, the samples used in the evaluation test whose results are shown in FIG. 7, were manufactured such that they satisfied the conditions of the projection length A being 0.90 mm, the tip overall length B being 1.50 mm, and the tip width W being 0.70 mm; and they differed from one another in terms of the tip thickness embedment ratio (C/D) and the tip inclination angle θ. The tip thickness embedment ratio (C/D) was changed among "0.15," "0.30," "0.45," "0.60," and "0.70." The tip inclination angle θ was changed among "0°," "2°," "5°," "10°," "15°," "20°," "25°," "30°," and "35°."

Specifically, in the evaluation test whose results are shown in FIG. 7, like in the evaluation test of FIG. 4, each sample was subjected to 1000 heating cycles each composed of heating of the sample at 1050° C. for 2 minutes and subsequent cooling of the sample for one minute at room temperature. After that, the sample was cut, and there was calculated the oxide scale change percentage Rc, which is the ratio of a portion of the joint portion between the ground electrode base member 41 and the noble metal tip 42, the portion having changed to oxide scale. In FIG. 7, the horizontal axis represents the tip inclination angle θ, and the vertical axis represents the oxide scale change percentage Rc, whereby the relation between the tip thickness embedment ratio (C/D) and oxide scale is shown.

As shown in FIG. 7, it was found that in the case of samples whose tip thickness embedment ratio (C/D) is "0.70," the oxide scale change percentage Rc exceeds 50% (the separation limit) irrespective of the tip inclination angle θ. It was also found that, in the case of samples whose tip thickness embedment ratio (C/D) is "0.15," "0.30," "0.45," or "0.60," when the tip inclination angle θ satisfies the relation "2°≦θ≦25°," the oxide scale change percentage Rc becomes less than 50%, and found that the oxide scale change percentage Rc decreases as the tip thickness embedment ratio (C/D) decreases. In particular, in the case of samples whose tip thickness embedment ratio (C/D) is "0.15," "0.30," or "0.45, when the tip inclination angle θ satisfies the relation "2°≦θ≦25°," the oxide scale change percentage Rc becomes equal to or less than 25%, and generation of oxide scale can be suppressed sufficiently.

The results of the above-described evaluation test shown in FIG. 7 demonstrate that the tip thickness embedment ratio (C/D) preferably satisfies a relation "(C/D)≦0.60," more preferably a relation "(C/D)≦0.30," most preferably a relation "(C/D)≦0.15."

A-6. Evaluation Value Regarding the Formation State of the Weld 43

Figure 12:
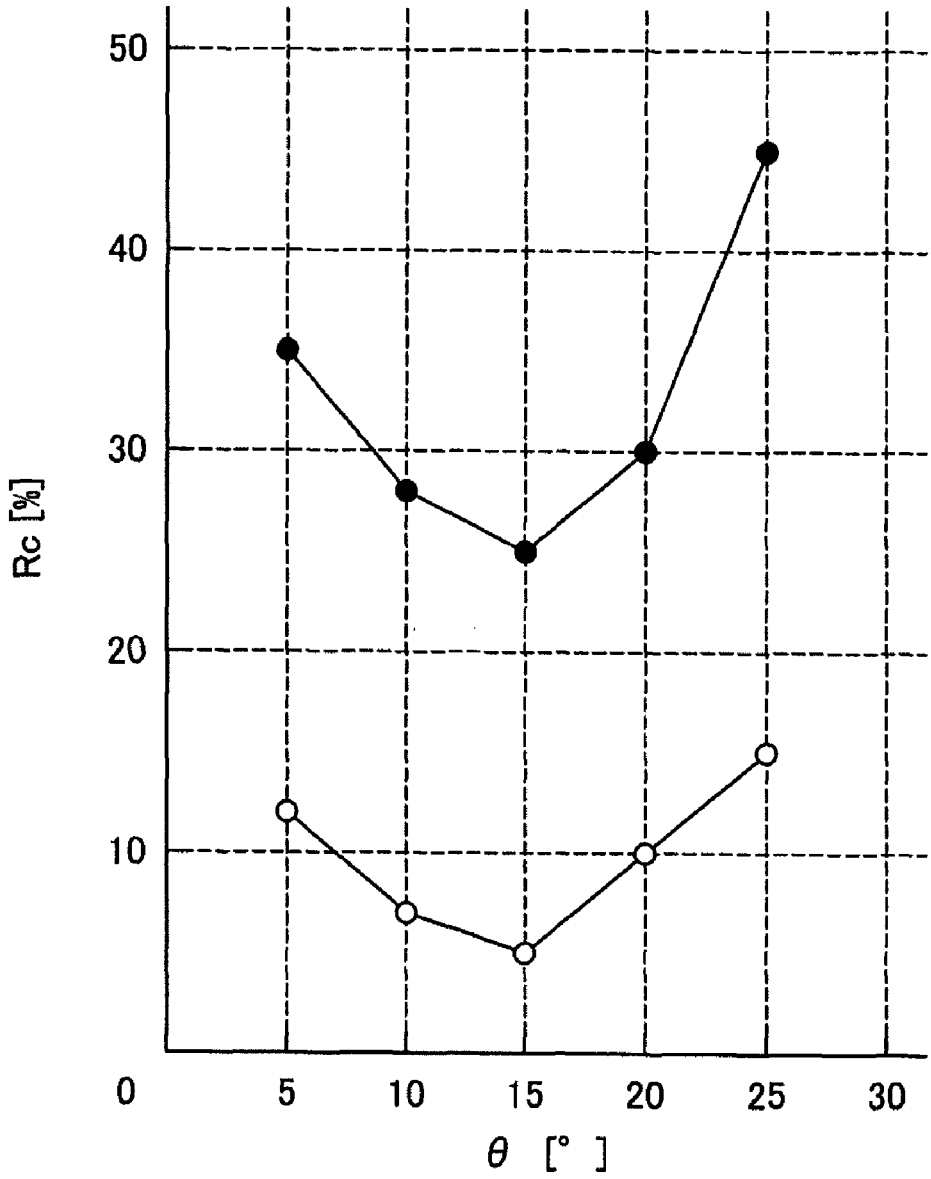
FIG. 12 is an explanatory graph showing the results of an evaluation test for investing oxide scale and tip inclination angle for different weld formation states.

FIG. 12 is an explanatory graph showing the results of an evaluation test for investing oxide scale and the tip inclination angle θ for different weld formation states of the weld 43. In the evaluation test whose results are shown in FIG. 12, a plurality of samples differing in the shape of the weld 43 were prepared and heated. After that, the ground electrode 40 of each sample was cut, and formation of oxide scale at the joint portion between the ground electrode base member 41 and the noble metal tip 42 was checked.

Specifically, the samples used in the evaluation test whose results are shown in FIG. 12 were manufactured such that they satisfied the conditions of the projection length A being 0.90 mm, the tip overall length B being 1.50 mm, the tip width W being 0.70 mm, and the tip thickness embedment ratio (C/D) being 0.60; and they differed from one another in terms of the formation state of the weld 43 and the tip inclination angle θ. The formation state of the weld 43 was changed between a state in which the weld 43 reaches the boundary regions Ae1 and Ae2 and a state in which the weld 43 does not reach the boundary regions Ae1 and Ae2. Samples were manufactured while the tip inclination angle θ was changed among "5°," "10°," "15°," "20°," and "25°" for each formation state of the weld 43.

Specifically, in the evaluation test whose results are shown in FIG. 12, like in the evaluation test of FIG. 4, each sample was subjected to 1000 heating cycles each composed of heating of the sample at 1050° C. for 2 minutes at room temperature and subsequent cooling of the sample for one minute at room temperature. After that, the sample was cut, and there was calculated the oxide scale change percentage Rc, which is the ratio of a portion of the joint portion between the ground electrode base member 41 and the noble metal tip 42, the portion having changed to oxide scale. In FIG. 12, the horizontal axis represents the tip inclination angle θ, and the vertical axis represents the oxide scale change percentage Rc. The evaluation values of the samples in which the weld 43 extends to the boundary regions Ae1 and Ae2 are plotted by use of white circles, and the evaluation values of the samples in which the weld 43 does not extend to the boundary regions Ae1 and Ae2 are plotted by use of black circles.

As shown in FIG. 12, it was found that when the tip inclination angle θ satisfies the relation "5°≦θ≦25°," the oxide scale change percentage Rc does not exceed 50% (the separation limit), irrespective of whether or not the weld 43 extends to the boundary regions Ae1 and Ae2. It is also found that, in the case where the weld 43 extends to the boundary regions Ae1 and Ae2, the oxide scale change percentage Rc decreases, as compared with the case where the weld 43 does not extend to the boundary regions Ae1 and Ae2.

The results of the above-described evaluation test shown in FIG. 12 demonstrate that the weld 43 is preferably formed such that it extends to the boundary regions Ae1 and Ae2; i.e., the weld 43 is present in the boundary regions Ae1 and Ae2 as well.

A-7. Steps of Manufacturing the Spark Plug

Figure 8:
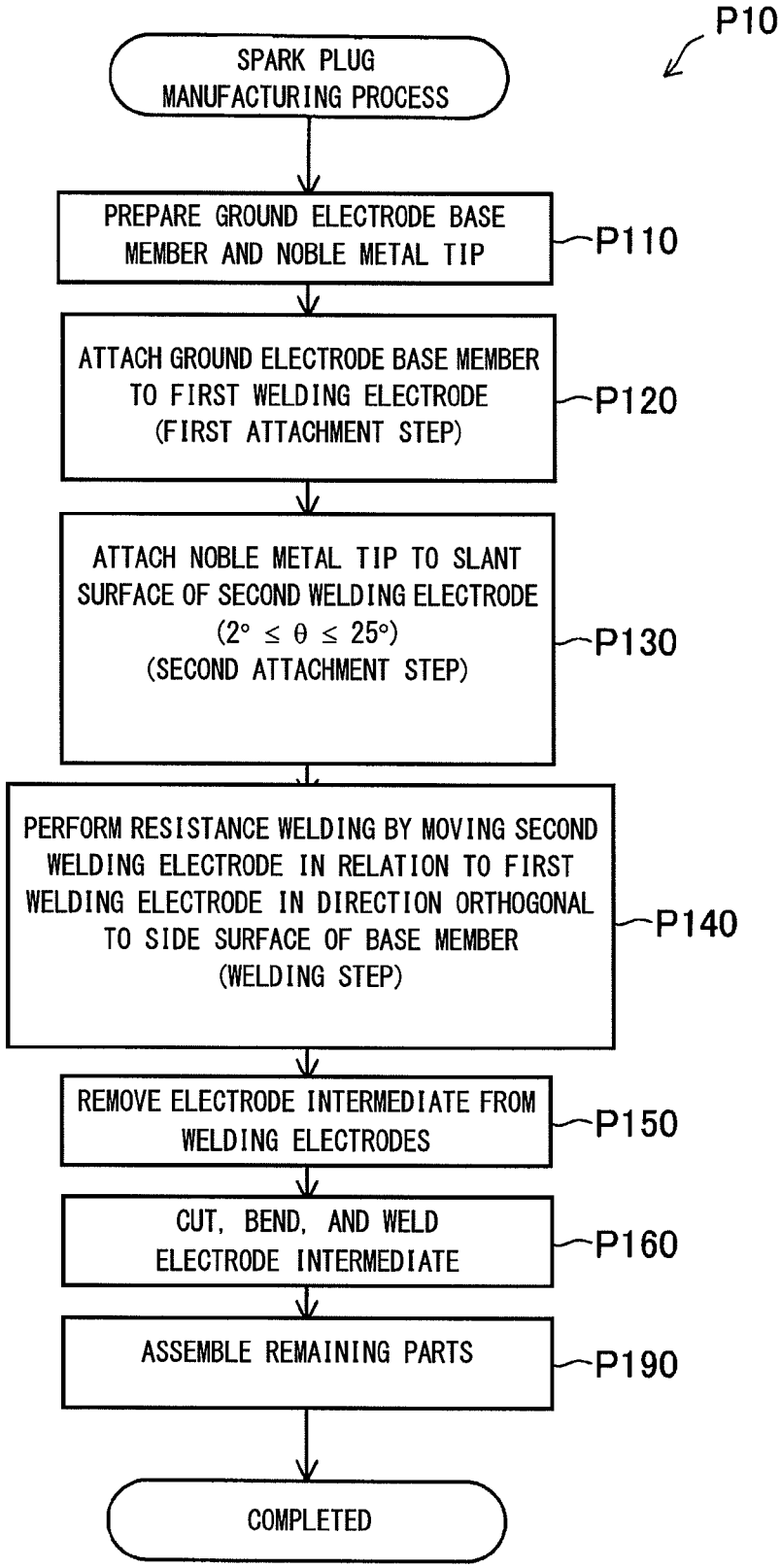
FIG. 8 is a flowchart showing steps for manufacturing a spark plug.
Figure 9:
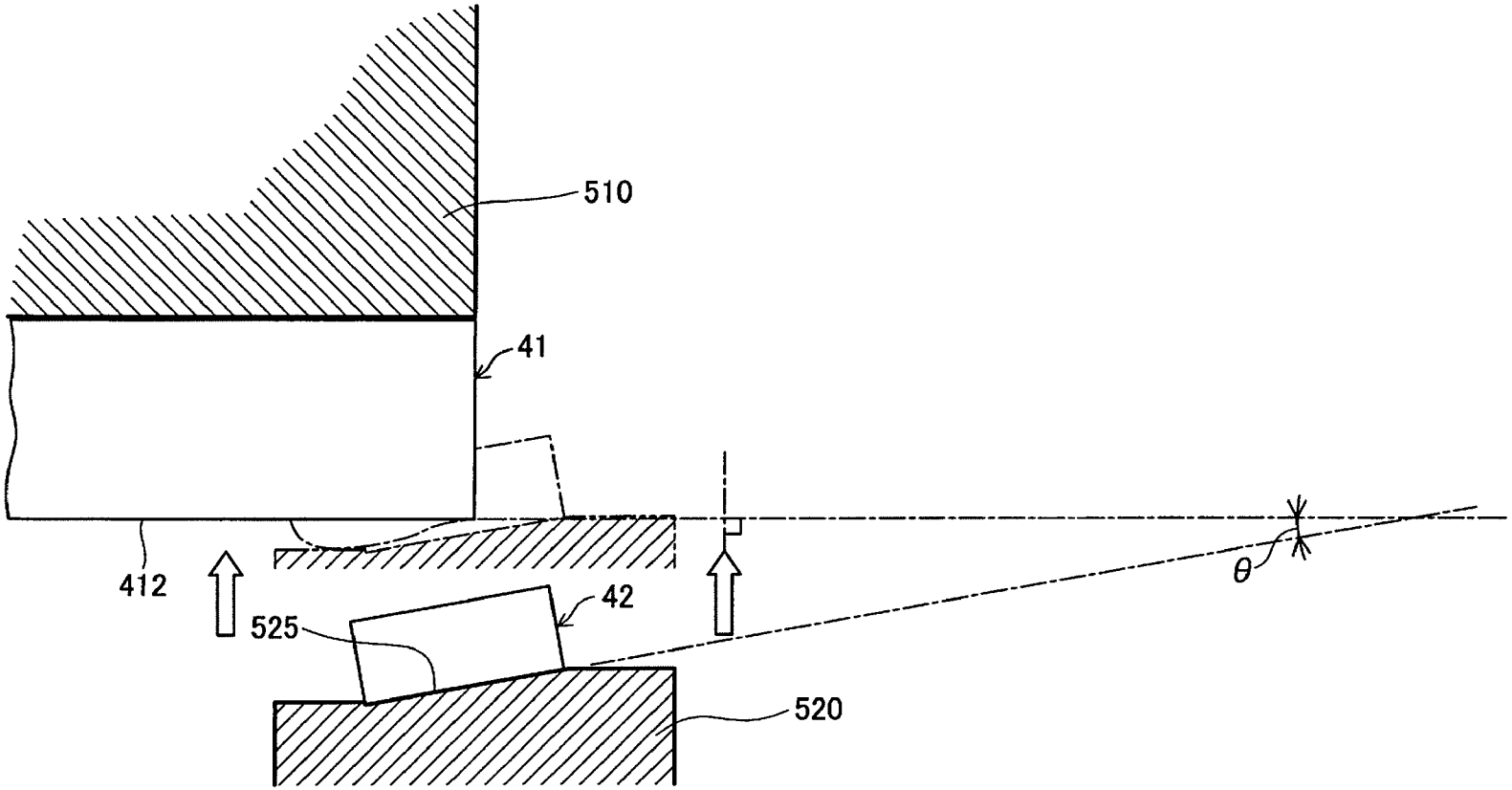
FIG. 9 is a view showing an operation of joining a noble metal tip to the base member of the ground electrode by means of resistance welding.

FIG. 8 is a flowchart showing steps (process P10) for manufacturing a spark plug 100. FIG. 9 is a view showing an operation of resistance-welding the noble metal tip 42 to the ground electrode base member 41. In the steps (process P10) for manufacturing the spark plug 100, the ground electrode base member 41 and the noble metal tip 42 are prepared for manufacture of the ground electrode 40 (process P110). In the present embodiment, the ground electrode base member 41, which is prepared before the resistance welding of the noble metal tip 42, is a straight member, unlike the ground electrode base member 41 of the ground electrode 40 in a completed product.

After the ground electrode base member 41 and the noble metal tip 42 are prepared (process P110), a first attachment step (process P120) for attaching the ground electrode base member 41 to a first welding electrode 510 is performed. In the first attachment step (process P120), as shown in FIG. 9, the ground electrode base member 41 is attached to the first welding electrode 510 such that the third base member surface 413 of the ground electrode base member 41 faces the first welding electrode 510.

After the first attachment step (process P120), a second attachment step (process P130) for attaching the noble metal tip 42 to a second welding electrode 520 is performed. In the second attachment step (process P130), as shown in FIG. 9, the noble metal tip 42 is attached to a slant surface 525 of the second welding electrode 520, which surface inclines at an angle θ (2°≦θ≦25°) in relation to the second base member surface 412 of the ground electrode base member 41 attached to the first welding electrode 510.

After the second attachment step (process P130), a welding step (process P140) for resistance-welding the noble metal tip 42 to the ground electrode base member 41 is performed. In the welding step (process P140), as shown in FIG. 9, the second welding electrode 520, to which the noble metal tip 42 has been attached, is moved in relation to the first welding electrode 510, to which the ground electrode base member 41 has been attached, in a direction orthogonal to the second base member surface 412 of the ground electrode base member 41 attached to the first welding electrode 510. Thus, the ground electrode base member 41 and the noble metal tip 42 are pressed together between the first welding electrode 510 and the second welding electrode 520. In this state, current is caused to flow through the ground electrode base member 41 and the noble metal tip 42.

After the welding step (process P140), an electrode intermediate (the ground electrode base member and the noble metal tip 42 joined thereto through resistance welding) is removed from the first welding electrode 510 and the second welding electrode 520 (process P150). After that, the electrode intermediate is cut and bent in accordance with the shape of the ground electrode 40 of a completed product, and is then welded to the metallic shell 30 (process P160). After that, the remaining members are attached to the metallic shell 30, to which the ground electrode 40 has been welded, (process P190), whereby the spark plug 100 is completed.

A-8. Effects

According to the above-described spark plug 100, the tip inclination angle θ satisfies the relation "2°≦θ≦25°." Thus, fusion of the ground electrode base member 41 and the noble metal tip 42 at the time of resistance welding is accelerated, and, as demonstrated by the results of the evaluation test shown in FIG. 4, the joint strength between the ground electrode base member 41 and the noble metal tip 42 can be increased. As a result, the durability of the spark plug 100 can be enhanced.

Since the weld 43 extends to the boundary regions Ae1, Ae2 of the second base member surface 412 of the ground electrode base member 41, the joint strength between the ground electrode base member 41 and the noble metal tip 42 can be increased sufficiently.

Since the width ratio {(H1+H2)/W} satisfies the relation "{(H1+H2)/W}≧0.40," as demonstrated by the results of the evaluation test shown in FIG. 5, the joint strength between the ground electrode base member 41 and the noble metal tip 42 can be increased sufficiently.

Since the tip length embedment ratio (A/B) satisfies the relation "(A/B)≦0.60," as demonstrated by the results of the evaluation test shown in FIG. 6, the joint strength between the ground electrode base member 41 and the noble metal tip 42 can be increased sufficiently.

Since the tip thickness embedment ratio (C/D) satisfies the relation "(C/D)≦0.60," as demonstrated by the results of the evaluation test shown in FIG. 7, the joint strength between the ground electrode base member 41 and the noble metal tip 42 can be increased sufficiently.

B. Modification

Figure 10:
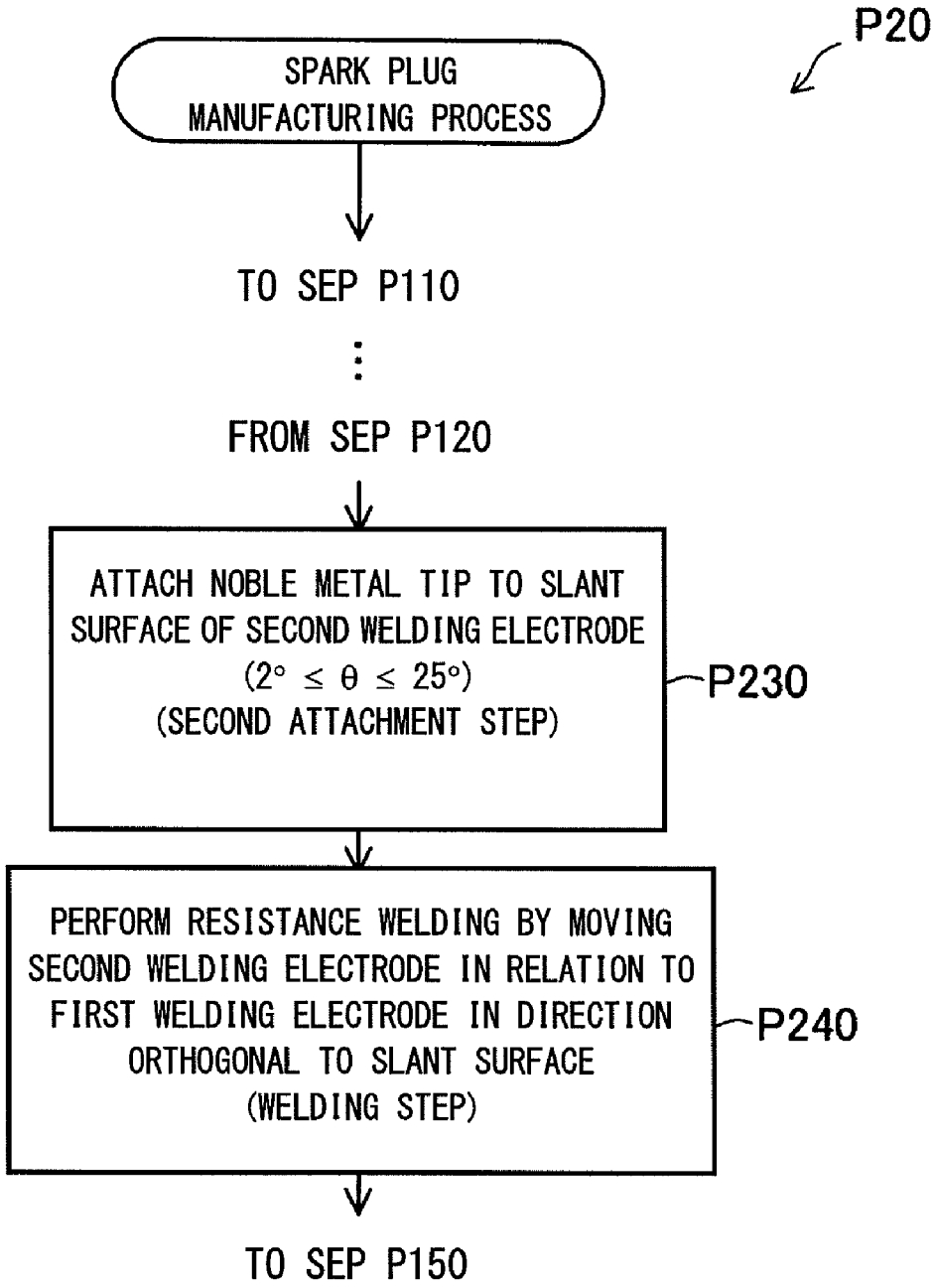
FIG. 10 is a flowchart showing steps for manufacturing a spark plug according to a modification.
Figure 11:
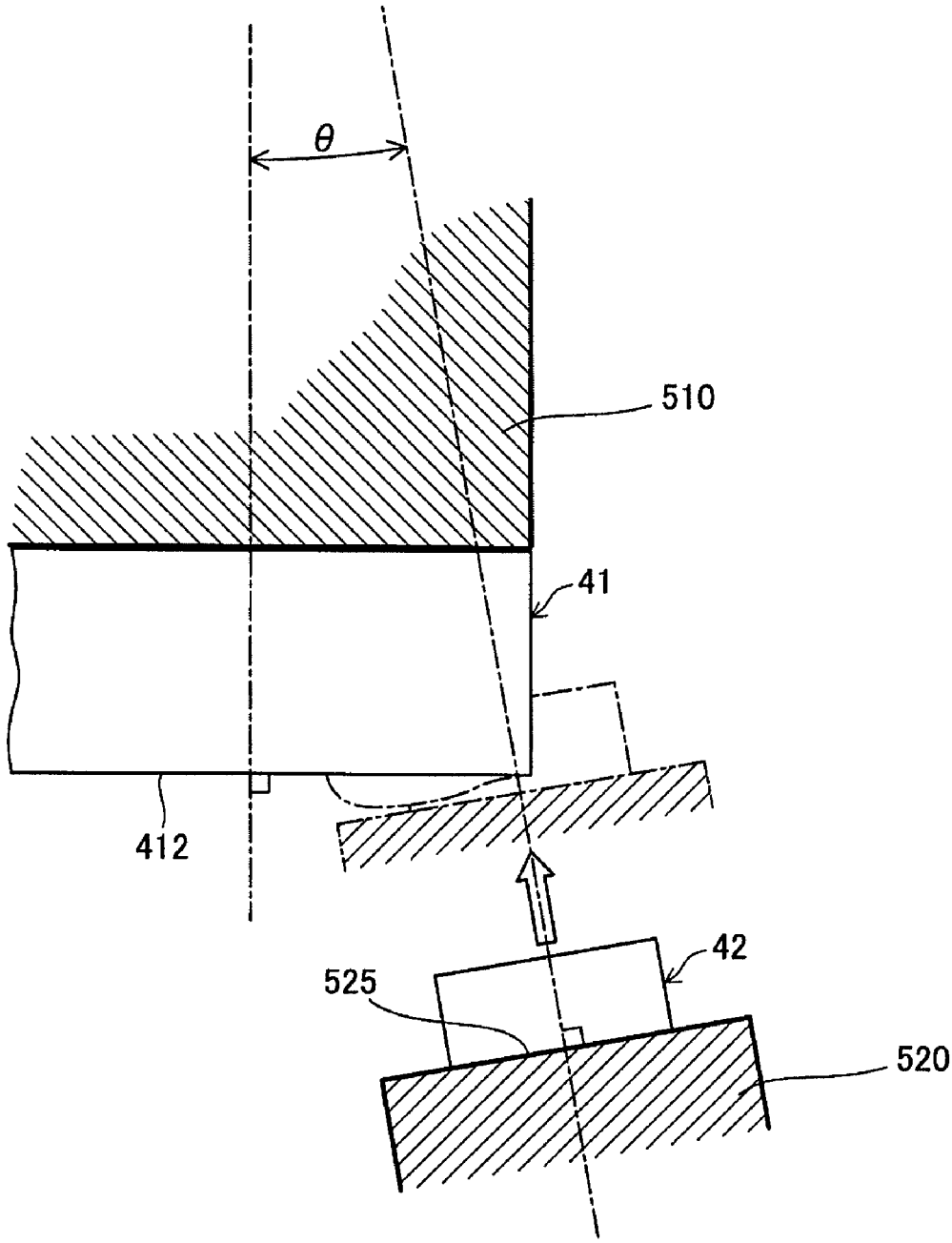
FIG. 11 is a view showing an operation of joining a noble metal tip to the base member of the ground electrode by means of resistance welding in the modification.

FIG. 10 is a flowchart showing steps (process P20) for manufacturing the spark plug 100 according to a modification. FIG. 11 is a view showing an operation of resistance-welding the noble metal tip 42 to the ground electrode base member 41 in the modification. In the steps (process P20) for manufacturing the spark plug 100 according to the modification, like the manufacturing steps (process P10) of FIG. 8, after the ground electrode base member 41 and the noble metal tip 42 are prepared (process P110), the first attachment step (process P120) for attaching the ground electrode base member 41 to the first welding electrode 510 is performed.

After the first attachment step (process P120) in the modification, a second attachment step (process P230) for attaching the noble metal tip 42 to the second welding electrode 520 is performed. In the second attachment step (process P230), as shown in FIG. 11, the noble metal tip is attached to the slant surface 525 of the second welding electrode 520, which surface inclines at an angle θ (2°≦θ≦25°) in relation to the second base member surface 412 of the ground electrode base member 41 attached to the first welding electrode 510.

After the second attachment step (process P230), a welding step (process P240) for resistance-welding the noble metal tip 42 to the ground electrode base member 41 is performed. In the welding step (process P240), as shown in FIG. 11, the second welding electrode 520, to which the noble metal tip 42 has been attached, is moved in relation to the first welding electrode 510, to which the ground electrode base member 41 has been attached, in a direction orthogonal to the slant surface 525 of the second welding electrode 520. Thus, the ground electrode base member 41 and the noble metal tip 42 are pressed together between the first welding electrode 510 and the second welding electrode 520. In this state, current is caused to flow through the ground electrode base member 41 and the noble metal tip 42.

After the welding step (process P240), like the manufacturing steps (process P10) of FIG. 8, the electrode intermediate is taken out (process P150), the electrode intermediate is bent and welded to the metallic shell 30 (process P160), and the remaining members are attached to the metallic shell 30 (process P190), whereby the spark plug 100 is completed.

C. Other Embodiments

Although the embodiment of the present invention has been described, needless to say, the present invention is not limited to such embodiment, and may be practiced in various modes without departing the scope of the invention.

For example, the present invention is not limited to the case where the ground electrode base member 41 has the same cross-sectional shape (taken perpendicular to the center axis CA2) throughout the entire length thereof. Also, the present invention is not limited to the case where the noble metal tip 42 has the same cross-sectional shape (taken perpendicular to the center axis CA3) throughout the entire length thereof.

Figure 13:
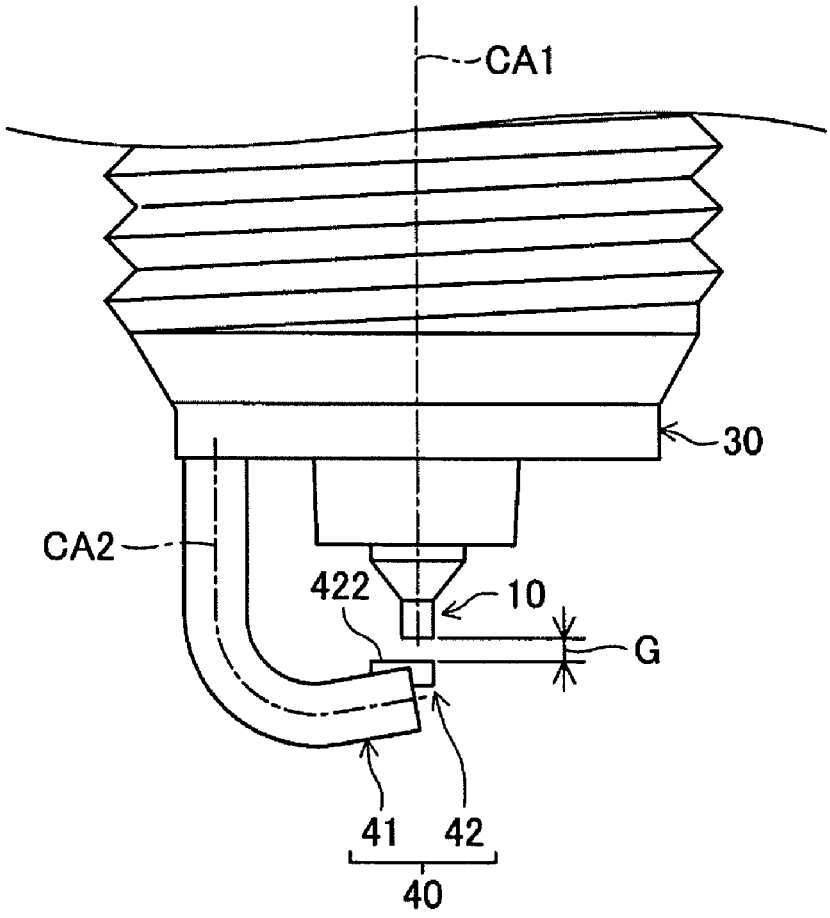
FIG. 13 is an explanatory view showing, on an enlarged scale, a ground electrode in another embodiment.

FIG. 13 is an explanatory view showing, on an enlarged scale, the ground electrode 40 in another embodiment. The embodiment shown in FIG. 13 is identical with the above-described embodiment, except that the second tip surface 422 of the noble metal tip 42 is parallel to the facing surface of the center electrode 10. That is, in the embodiment shown in FIG. 13, the ground electrode base member 41 is bent toward the center electrode 10 up to a point where the second tip surface 422 of the noble metal tip 42 becomes orthogonal to the center axis CA1 of the center electrode 10. In the embodiment shown in FIG. 13, the tip inclination angle θ is the same as that employed in the above-described embodiment.

The foregoing description is a specific embodiment of the present invention. It should be appreciated that this embodiment is described for purposes of illustration only, and that numerous alterations and modifications may be practiced by those skilled in the art without departing from the spirit and scope of the invention. It is intended that all such modifications and alterations be included insofar as they come within the scope of the invention as claimed or the equivalents thereof.

Having described the invention, the following is claimed:

1. A spark plug comprising:

a rodlike center electrode;

an insulator provided around the center electrode;

a cylindrical tubular metallic shell provided around the insulator; and a ground electrode which is joined at one end to the metallic shell and which forms at the other end a gap in cooperation with the center electrode, the ground electrode including a ground electrode base member which forms a front end surface and a side surface at the other end, and a rodlike noble metal tip which is embedded in the ground electrode base member, through resistance welding, such that the noble metal tip projects from the front end surface and the side surface and which has a facing surface facing the center electrode, the spark plug being characterized in that a direction along which the noble metal tip projects from the front end surface of the ground electrode base member coincides with a longitudinal direction of the noble metal tip and slants in relation to a center axis of the ground electrode base member; and an inclination angle θ of a center axis of the noble metal tip along the longitudinal direction in relation to the center axis of the ground electrode base member satisfies a relation 2°≦θ≦25°.

2. A spark plug according to claim 1, wherein a weld produced through partial melting of the ground electrode base member and the noble metal tip through the resistance welding is present on the side surface of the ground electrode base member around the noble metal tip; and the weld extends to boundary regions on the side surface of the ground electrode base member, the boundary regions extending from a boundary between the side surface and the front end surface over a distance of 0.10×L, where L represents a tip embedment length L, which is a length of a portion of the side surface of the ground electrode base member where the noble metal tip is embedded in the ground electrode base member.

3. A spark plug according to claim 1 or 2, wherein a weld produced through partial melting of the ground electrode base member and the noble metal tip through the resistance welding is present on the side surface of the ground electrode base member around the noble metal tip; and a relation $\{(H1+H2)/W\} \geqq 0.40$ is satisfied, where H1 and H2 represent respective widths of portions of the weld located on opposite sides of the noble metal tip, as measured at a reference position which is shifted, by a distance of 0.25×L, from a boundary between the side surface and the front end surface of the ground electrode base member, where L represents a tip embedment length L, which is a length of a portion of the side surface of the ground electrode base member where the noble metal tip is embedded in the ground electrode base member, and W represents a tip width, which is a width of the facing surface as measured along a direction orthogonal to the longitudinal direction of the noble metal tip.

4. A spark plug according to claim 1 or 2, wherein a relation $(A/B) \leqq 0.60$ is satisfied where A represents a projection length, which is a length of a portion of the noble metal tip, which portion projects from the front end surface of the ground electrode base member, and B represents a tip overall length, which is a length of the noble metal tip as measured along the longitudinal direction.

5. A spark plug according to claim 1 or 2, wherein a relation $(C/D) \leqq 0.60$ is satisfied where C represents a projection thickness, which is a length of a portion of the noble metal tip, which portion projects from the side surface of the ground electrode base member, and D represents a tip thickness, which a length of the noble metal tip as measured along a direction along which the noble metal tip is embedded into the side surface.

6. A method for manufacturing a spark plug which comprises:

a rodlike center electrode;

an insulator provided around the center electrode;

a cylindrical tubular metallic shell provided around the insulator; and a ground electrode which is joined at one end to the metallic shell and which forms at the other end a gap in cooperation with the center electrode, the ground electrode including a ground electrode base member which forms a front end surface and a side surface at the other end, and a rodlike noble metal tip which is embedded in the ground electrode base member, through resistance welding, such that the noble metal tip projects from the front end surface and the side surface and which has a facing surface facing the center electrode, the method being characterized by comprising:

a first attachment step of attaching the ground electrode base member to a first welding electrode;

a second attachment step of attaching the noble metal tip to a slant surface of a second welding electrode which surface slants at an angle θ in relation to the side surface of the ground electrode base member attached to the first welding electrode, the angle satisfying a relation $2° \leqq \theta \leqq 25°$; and a welding step of moving the second welding electrode holding the noble metal tip attached thereto, in relation to the first welding electrode holding the ground electrode base member attached thereto, in a direction orthogonal to the side surface of the ground electrode base member attached to the first welding electrode, to thereby press the ground electrode base member and the noble metal tip together between the first welding electrode and the second welding electrode, and causing, in this state, a current to flow through the ground electrode base member and the noble metal tip.

7. A method for manufacturing a spark plug which comprises:

a rodlike center electrode;

an insulator provided around the center electrode;

a cylindrical tubular metallic shell provided around the insulator; and a ground electrode which is joined at one end to the metallic shell and which forms at the other end a gap in cooperation with the center electrode, the ground electrode including a ground electrode base member which forms a front end surface and a side surface at the other end, and a rodlike noble metal tip which is embedded in the ground electrode base member, through resistance welding, such that the noble metal tip projects from the front end surface and the side surface and which has a facing surface facing the center electrode, the method being characterized by comprising:

a first attachment step of attaching the ground electrode base member to a first welding electrode;

a second attachment step of attaching the noble metal tip to a slant surface of a second welding electrode which surface slants at an angle θ in relation to the side surface of the ground electrode base member attached to the first welding electrode, the angle satisfying a relation $2° \leqq \theta \leqq 25°$; and a welding step of moving the second welding electrode holding the noble metal tip attached thereto, in relation to the first welding electrode holding the ground electrode base member attached thereto, in a direction orthogonal to the slant surface of the second welding electrode, to thereby press the ground electrode base member and the noble metal tip together between the first welding electrode and the second welding electrode, and causing, in this state, a current to flow through the ground electrode base member and the noble metal tip.

8. A spark plug according to claim 3, wherein a relation $(A/B) \leqq 0.60$ is satisfied where A represents a projection length, which is a length of a portion of the noble metal tip, which portion projects from the front end surface of the ground electrode base member, and B represents a tip overall length, which is a length of the noble metal tip as measured along the longitudinal direction.

9. A spark plug according to claim 3, wherein a relation $(C/D) \leqq 0.60$ is satisfied where C represents a projection thickness, which is a length of a portion of the noble metal tip, which portion projects from the side surface of the ground electrode base member, and D represents a tip thickness, which a length of the noble metal tip as measured along a direction along which the noble metal tip is embedded into the side surface.

10. A spark plug according to claim 4, wherein a relation $(C/D) \leqq 0.60$ is satisfied where C represents a projection thickness, which is a length of a portion of the noble metal tip, which portion projects from the side surface of the ground electrode base member, and D represents a tip thickness, which a length of the noble metal tip as measured along a direction along which the noble metal tip is embedded into the side surface.

* * * * *